US007055299B2

(12) United States Patent
Suolahti et al.

(10) Patent No.: US 7,055,299 B2
(45) Date of Patent: Jun. 6, 2006

(54) WRAPPING MACHINE FOR WRAPPING A PLASTIC FOIL WEB AROUND AN OBJECT

(75) Inventors: Yrjö Suolahti, Mynämäki (FI); John Wojcik, South Barrington, IL (US); Jan Toczycki, Chicago, IL (US)

(73) Assignee: Illinois Tool Works Inc., Glenview, IL (US)

( * ) Notice: Subject to any disclaimer, the term of this patent is extended or adjusted under 35 U.S.C. 154(b) by 0 days.

(21) Appl. No.: 10/828,229

(22) Filed: Apr. 21, 2004

(65) Prior Publication Data

US 2004/0211154 A1 Oct. 28, 2004

(30) Foreign Application Priority Data

Apr. 22, 2003 (FI) ..... 20030608

(51) Int. Cl.
*B65B 11/02* (2006.01)

(52) U.S. Cl. ..... 53/588

(58) Field of Classification Search ..... 53/588; B65B 11/02

See application file for complete search history.

(56) References Cited

U.S. PATENT DOCUMENTS

| | | | | |
|---|---|---|---|---|
| 4,216,640 | A * | 8/1980 | Kaufman | 53/556 |
| 5,452,566 | A * | 9/1995 | Benhamou et al. | 53/588 |
| 5,802,810 | A | 9/1998 | Wojcik et al. | |
| 6,065,269 | A * | 5/2000 | Malnati | 53/588 |
| 6,453,643 | B1 | 9/2002 | Buscherini et al. | |
| 6,526,729 | B1 * | 3/2003 | Herava | 53/588 |

FOREIGN PATENT DOCUMENTS

| | | |
|---|---|---|
| EP | 0 289 784 A1 | 3/1988 |
| EP | 0 811 554 A1 | 12/1997 |
| EP | 0 934 880 A2 | 8/1999 |
| FI | 91624 B | 4/1994 |

* cited by examiner

*Primary Examiner*—Stephen F. Gerrity
(74) *Attorney, Agent, or Firm*—Lowe Hauptman & Berner, LLP

(57) ABSTRACT

In a wrapping machine for wrapping a plastic foil web (F) around an object, a gripping and cutting device (11) is connected to a lifting frame (3) supporting a circular guide track of a foil dispenser (6) so as to be vertically movable with the lifting frame.

16 Claims, 7 Drawing Sheets

WRAPPING MACHINE FOR WRAPPING A PLASTIC FOIL WEB AROUND AN OBJECT

FIELD OF THE INVENTION

The present invention relates to a wrapping machine.

BACKGROUND OF THE INVENTION

In prior art, specification U.S. Pat. No. 5,802,810 discloses a wrapping machine for wrapping a plastic foil web around an object to be packaged. The object to be wrapped is usually a load placed on a pallet, which typically is an assembly of the form of a rectangular parallelepiped.

U.S. Pat. No. 5,802,810 mainly describes a crank arm wrapping machine but, according to the specification, the special gripping and cutting device presented in it can also be applied in a ring-type wrapping machine. A ring-type wrapping machine usually has a machine frame supported on a fixed base and comprising a lifting frame which can be moved by a power means along upright vertical columns. A circular guide track is mounted on the lifting frame so as to be vertically movable with it. A film dispensing unit, on which a film web roll can be rotatably mounted, has been arranged to circulate along the circular guide track along a ring-like path around the object to be packaged to deliver plastic film web from the film web roll so as to form a wrapping around the object to be packaged.

U.S. Pat. No. 5,802,810 discloses a gripping and cutting device implemented with two swing arms, which is designed to replace an earlier gripping and hot seaming device, which at the end of the wrapping operation melts the film web onto the film web layer below by means of an electrically heated resistance wire and then cuts the film web beside the seaming line.

The function of the gripping and cutting device described in specification U.S. Pat. No. 5,802,810 is to hold the end of the film web at the start of the wrapping operation until it is caught between at least one film web layer and the object so that it will stay there. At the final stage of the wrapping operation, the gripping and cutting device is to terminate or cut the film web and leave the said end between at least one film web layer wrapped and the object. After that, the free end of the severed film web remains in the grip of the gripping and cutting device to be ready for the start of the next wrapping operation. This type of gripping and cutting device comprises a device frame. Further, the gripping and cutting device comprises a first swing arm, which is pivotally connected to the device frame via a first joint allowing a turning motion between a horizontal position and a vertical position. The first swing arm also comprises a first holding device for gripping and holding the film web. A second swing arm is pivotally connected to the device frame via a second joint disposed at a distance from the first joint and allowing a turning motion between a horizontal position and an upright position. The second swing arm comprises a second holding device for gripping and holding the constricted film web and a cutting device for cutting the film web. This prior-art gripping and cutting device is mounted on the device frame, which is supported on a fixed base, e.g. a floor, and is disposed in a wrapping station, where it can be moved to a position near the lower part of the object to be wrapped.

In itself, the above-mentioned swing-arm type gripping and cutting device has many advantages as compared with the prior-art gripping and seaming device that uses a melting technique. It comprises fewer moving parts and less control.

In the device based on a melting technique, the resistance wire has to be supplied with an electric current to heat it, and on the other hand this heating has to be controlled. In the swing-arm type device, only the turning motion of the arms has to be controlled to make them turn at the right time. In addition, in the use of the swing-arm type device, the tension of the film web may vary, whereas for the operation of the seaming device using a melting technique it is necessary that that film web should be under a certain tension, i.e. not too tight and not too loose. It is therefore advantageous to use the swing-arm type gripping and cutting device because it is simpler in structure, requires less control and is not sensitive to variations in film tension.

However, the wrapping machine according to specification U.S. Pat. No. 5,802,810 involves the problem that, as the aforesaid gripping and cutting device implemented using swing arms is disposed near the lower part of the object to be wrapped, the wrapping action always has to be started from the lower part and finally ended at the lower part. Thus, wrapping is started from below, the film web is wrapped around the object in an ascending spiral form. After the object has been wrapped up to its top, more film web is then wrapped around the object in a descending spiral form to reach the lower part of the object again so that the film web can be terminated. Thus, when the prior-art device is used, the object always has to be wrapped twice over. Usually a single wrapping would be sufficient, so with the prior-art device an unnecessarily large amount of film web per object to be wrapped is consumed. In addition, double wrapping requires a long time. A further problem is that, with the prior-art wrapping machine, a so-called surface wrapping can only be made at the lower part of the object to be wrapped. Surface wrapping means that the film is not wrapped in spiral form but on a single given surface to form a ring-like collar around the object.

OBJECT OF THE INVENTION

The object of the present invention is to overcome the above-mentioned drawbacks.

A specific object of the invention is to disclose a wrapping machine in which the wrapping action can be started and ended at any desired position in the vertical direction of the object to be wrapped.

BRIEF DESCRIPTION OF THE INVENTION

The wrapping machine of the invention comprises

- a machine frame supported on a fixed base and comprising vertical upright columns,
- a lifting frame arranged to be moved upwards and downwards in a vertical direction while guided by the upright columns,
- a power means for moving the lifting frame,
- a circular guide track supported on the lifting frame so as to be vertically movable together with it,
- a foil dispenser, on which a foil web roll can be rotatably mounted, said foil dispenser being arranged to circulate on a ring-like path, guided by the circular guide track, about the object to be packaged for delivering plastic foil web from the foil web roll to form a wrapping around the object to be packaged, and
- a gripping and cutting device, which comprises a device frame, a first swing arm, connected to the device frame by a first joint so as to be turnable between a horizontal position and a vertical position, and said first swing arm comprising a first holding device for gripping and holding the foil web, and a cutting device for cutting the foil web, a second swing arm connected to the device frame by a second joint disposed at a distance from the first joint so as to be turnable between the horizontal position and the vertical position, said second swing arm comprising a second holding device for gripping and holding a constricted foil web.

According to the invention, the gripping and cutting device is coupled to the lifting frame so as to be vertically movable together with it.

The invention has the advantage that, being connected to the lifting frame moving upwards and downwards in a vertical direction, the gripping and cutting device can perform the starting and ending of the wrapping action at any vertical position relative to the object to be wrapped. It is possible to start the wrapping action from the upper part of the object, wrap the foil web spirally from the upper part of the object to its lower part and then terminate the foil web at the lower part of the object. Further, it is possible to start the wrapping action from the lower part of the object, wrap the foil web spirally from the lower part of the object to its upper part and then terminate the foil web at the upper part of the object. Partial wrapping and collar wrapping are also possible. Collar wrapping can be performed at any level in the vertical direction of the object, at the lower part, around the middle part or at the upper part.

In an embodiment of the wrapping machine, the wrapping machine comprises a crinkling device connected to the foil dispenser and having crinkling means for reducing the foil web delivered from the foil dispenser to a width narrower than full width. The holding devices have been fitted to grip the foil web constricted to a string-like form.

In an embodiment of the wrapping machine, the holding device comprises a dog placed at the end of a swing arm. Further, the holding device comprises a clutch guided by the swing arm so as to be movable towards and away from the dog for pressing the foil web constricted to a string-like form between the dog and the clutch. Moreover, the holding device comprises a power means for actuating the clutch.

In an embodiment of the wrapping machine, the cutting device comprised in the first swing arm comprises a cutting blade for severing the foil web constricted to a string-like form by cutting it apart.

In an embodiment of the wrapping machine, the lifting frame comprises substantially horizontal guide rails along which the device frame can be moved horizontally to move the gripping and cutting device towards and away from the object to be wrapped. Additionally a second power means is provided for moving the device frame.

In the method, a first swing arm, which has a first holding device holding the leading end of a foil web being delivered from a foil web roll, is placed in an upright position against the object to be wrapped. At least one layer of foil web is wrapped in substantially full width around the first swing arm and the object in such manner that at least part of the first swing arm remains between the wrapped foil web layer and the object. The end of the foil web is released from the first holding device. The first swing arm is turned to a horizontal position away from the position between the object and the foil web layer around the object. A desired amount of foil web is wrapped around the object while the first swing arm and a second swing arm are in a horizontal position. The second swing arm is set in an upright position close to the object. At least one foil web layer is wrapped around the second swing arm and the object in such manner that at least part of the second swing arm remains between the wrapped foil web layer and the object. The first swing arm is turned from the horizontal position to the upright position. The foil web is constricted by means of a crinkling device to a constricted string-like form and brought to a second holding device of the second swing arm and to the first holding device of the first swing arm, whereupon the string-like foil web is gripped by said holding devices. The foil web is severed by means of the cutting device of the first swing arm and the grip of the first and second holding devices on the string-like foil web is maintained further in such manner that the trailing end of the foil web wrapped around the object is in the grip of the second holding device and the foil web end drawn from the foil dispenser is in the grip of the first holding device, forming a leading end for a new wrapping operation. The second swing arm is removed from between the foil web layer and the object. The grip of the second holding device on the end of the foil web wrapped around the object is released and the grip of the first holding device on the leading end of the foil web being delivered from the foil dispenser is maintained.

According to the invention, the wrapping action is started from a freely chosen point relative to the vertical direction of the object to be wrapped and likewise ended at a freely chosen point relative to the vertical direction of the object to be wrapped.

In an embodiment of the method, the wrapping action is started from a point in or close to the upper part of the object to be wrapped and ended at a point in or close to the lower part of the object.

In an embodiment of the method, the wrapping action is started from the lower part of the object and ended at the upper part of the object.

In an embodiment of the method, the wrapping action is started from the middle area between the lower and upper parts of the object.

In an embodiment of the method, the wrapping action is ended at the lower part of the object.

In an embodiment of the method, the wrapping action is ended at the upper part of the object.

In an embodiment of the method, the wrapping action is ended at substantially the same height position as where it was started.

LIST OF FIGURES

In the following, the invention will be described in detail with reference to a few examples of its embodiments and the attached drawing, wherein FIG. 1 is an axonometric oblique top view of an embodiment of the wrapping machine of the invention, with the lifting frame and vertical column shown in partially sectioned form to give a visual perception of the gripping and cutting device, FIG. 2 presents the wrapping machine of FIG. 1 with the lifting frame and vertical column shown in partially sectioned form to give a visual perception of the drive arrangement of the lifting frame, FIG. 3 presents a sectional view of the wrapping machine in FIG. 1, taken along line III—III, FIG. 4 presents a sectional view taken along line IV—IV in FIG. 3, FIGS. 5–14 illustrate successive stages of the operation of the wrapping machine in FIG. 1 when the wrapping action is started and ended according to a first embodiment of the method of the invention, and FIGS. 15–22 illustrate successive stages of the operation of the wrapping machine in FIG. 1 when the wrapping action is started and ended according to a second embodiment of the method of the invention.

DETAILED DESCRIPTION OF THE INVENTION

FIG. 1 presents a wrapping machine 1 for wrapping a plastic foil web around an object (not shown) to be packaged.

The wrapping machine 1 comprises a machine frame 1 supported on a fixed floor base. The machine frame comprises four vertical upright columns 2 at a distance from each other in a rectangular array so that each upright column 2 is situated at a different corner of the imaginary rectangular array. A lifting frame 3 has been arranged to be movable upwards and downwards along the upright columns 2 by means of a lifting motor 4 (see also FIG. 2). Power is transmitted from the lifting motor 4 via power transmission means to produce a vertical motion of the lifting frame 3. As shown in FIG. 2, the aforesaid power transmission means comprise flexible flat belts 30 and belt pulleys 31 for transmitting the power of the lifting motor 4 to the flat belts.

A foil dispenser 6, on which a foil web roll 7 can be rotatably mounted, has been arranged to circulate on a ring-like circular path along the circular guide track 5, about the object to be packaged so that the plastic foil web is delivered from the foil web roll 7 to form a wrapping around the object to be packaged. As the circular guide track 5 supporting the foil dispenser 6 is simultaneously moved vertically by moving the lifting frame 3, a spiral wrapping is formed around the object to be wrapped.

The preferred drive arrangement for the lifting frame 3 has been described in an earlier Finnish patent application FI 20030304 by the same applicant, to which reference is made here. It is obvious that the motion of the lifting frame 3 can be implemented by using any other suitable arrangement known in itself.

From FIG. 2 it can be seen that the lifting motor 4 of the lifting frame 3 is preferably mounted on the lifting frame 3, in which case it will move together with the lifting frame 3. For coiling the flat belts 30, drive belt pulleys 31 are provided. The drive belt pulleys 31 are rotatably mounted with bearings on the lifting frame 3 and fastened to a drive shaft 32 driven via a reduction gear by the lifting motor 4. One end of each flat belt 30 is secured to the upper end of an upright column 2 while the other end is secured to a drive belt pulley 31.

The lifting frame 3 is a substantially rectangular frame disposed horizontally within the area defined by the upright columns 2. The lifting frame 3 comprises two elongated, mutually parallel box-like lateral frame parts 33, 34, each extending horizontally between two upright columns 2. The drive belt pulley 31 is placed inside the box of the lateral frame part. As shown in FIG. 2, a diverting pulley 35 is provided at each end of the two lateral frame parts 33, 34, over which diverting pulley the belt 30 extending substantially horizontally from the drive belt pulley 31 is diverted to a vertical direction and passed to the upper end of the upright column 2.

As shown in FIGS. 1, 3 and 4, the machine comprises a gripping and cutting device 11, which is connected to the lifting frame 3 and can therefore move upwards and downwards with the lifting frame 3.

The gripping and cutting device 11 comprises a device frame 12, which comprises an elongated beam 12 extending horizontally between the lifting frame 3 and the lateral frame parts 33, 34. Secured to the lateral frame parts 33, 34 are substantially horizontal guide rails 27, 27, along which the device frame 12 can be moved horizontally by means of a second power means 29, which is shown in FIG. 4, to move the gripping and cutting device towards and away from the object to be wrapped.

As is further shown in 3 and 4, the gripping and cutting device 11 comprises a first swing arm 13, which is pivoted on the device frame 12 by a first joint 14 so as to be turnable between a horizontal position I and an upright position II. For turning the first swing arm 13 between positions I and II, a power means 36, e.g. a pneumatic cylinder is 35 provided. Placed at the free end of the first swing arm 13 is a first holding device 15 for gripping the foil web and holding it and a cutting device 16 for cutting the foil web. The cutting device 16 comprises a cutting blade 26 for severing the foil web reduced to a string-like form by a knife-like cutting action.

A second swing arm 17 is pivotally connected to the device frame 12 via a second joint 18 disposed at a distance from the first joint 14 so that the second swing arm 17 can turn between a horizontal position I and an upright position II. The second swing arm comprises a second holding device 19 for gripping and holding the constricted foil web and a cutting device for cutting the foil web.

FIG. 4 is a diagrammatic sketch showing that the holding devices 15, 19 comprise a dog 23 placed at the end of the swing arm 13, 17. A clutch 24 is guided by the swing arm 13, 17 so as to be movable towards and away from the dog 23 for pressing the foil web constricted to a string-like form between the dog 23 and the clutch 24. A first power means 25, e.g. a pneumatic cylinder, for actuating the clutch 24 is provided.

The holding devices 15, 19 provided in the swing arms 13 and 17 have been fitted to grip the foil web constricted to a string-like form.

The wrapping machine further comprises a crinkling device 20 (see operational illustrations 5–22) connected to the foil dispenser 6. The crinkling device 20 may be any known crinkling device by means of which the foil web delivered from the foil dispenser to the object can be constricted to a width narrower than full-width, e.g. to a string-like form. Usually such a device comprises crinkling means 21, 22 movable towards and away from each other in the widthwise direction of the foil web, one of which crinkles the foil web from the lower edge while the other one crinkles the foil web from the upper edge. An advantageous crinkling device and its operation are described e.g. in Finnish patent application FI 20030421 by the same applicant, to which reference is made here. It is obvious that the crinkling device may also be any other suitable crinkling device known in itself.

Using the above-described wrapping machine, the wrapping action can be started from a freely chosen point on the object to be wrapped relative to its vertical direction, and similarly the wrapping action can be ended at a freely chosen point on the object to be wrapped relative to its vertical direction. Thus, wrapping can be started from the upper part of the object and ended at the upper part of the object. Likewise, wrapping can be started from the lower part of the object and ended at the upper part of the object. Furthermore, wrapping can be started from any desired point in the middle area of the object between the upper and lower parts, and ended at the upper or lower part of the object. Further, it is possible to start the wrapping action from any point and end it at the same point, i.e. to make a collar wrapping.

Referring to FIGS. 5–14, a method for wrapping an object with plastic foil web using a wrapping machine as illustrated in FIGS. 1–4 in an exemplary case where the wrapping action is started from the upper part of the object or from a point close to it and ended at the lower part of the object or at a point close to it.

FIG. 5 illustrates a case where the first swing arm 13 with the first holding device 15 holding the leading end $A_1$ of the foil web F being delivered from the foil web roll 7 is first set in the upright position II against the object to be wrapped. Referring to FIG. 4, this is accomplished by moving the device frame 12 by means of the power means 29 towards the object until the first swing arm 13 in the upright position II touches the side of the object.

FIG. 6 illustrates a situation where at least one foil web layer has been wrapped in substantially full width around the first swing arm 13 and the object so that at least part of the first swing arm 13 remains between the wrapped foil web layer and the object. The end of the foil web can now be released from the first holding device 15.

Figure 1:
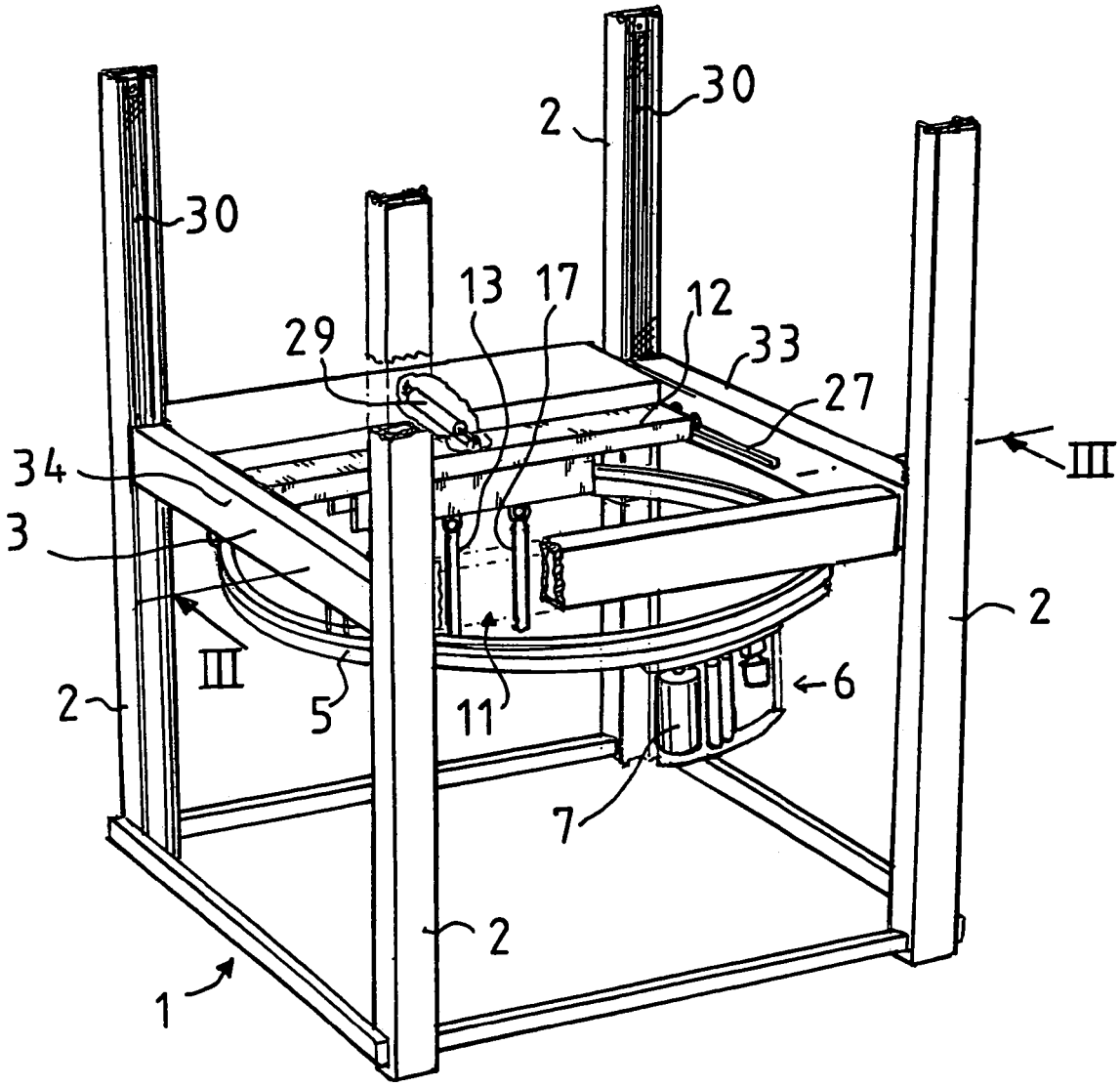
Figure 2:
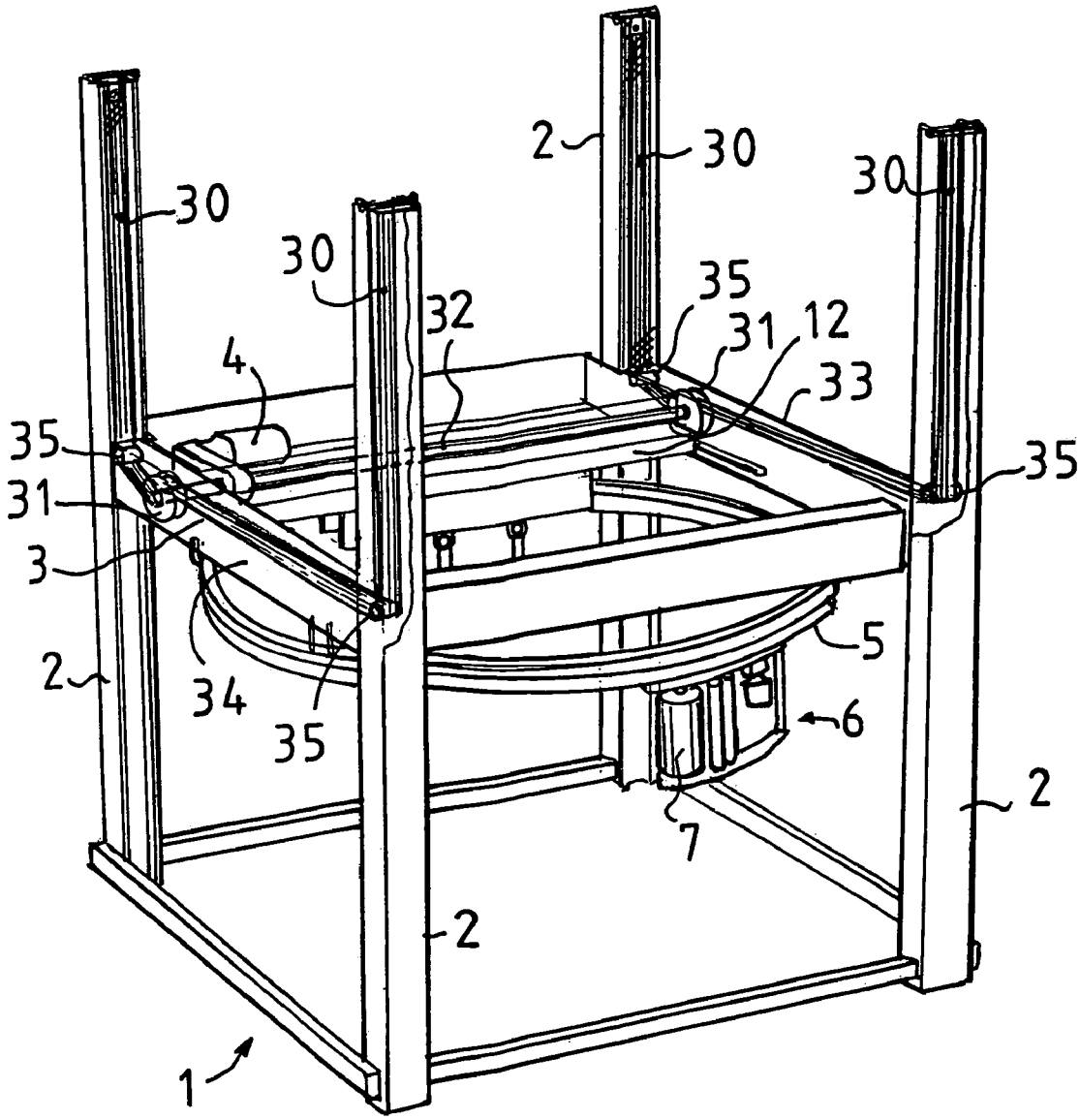
Figure 3:
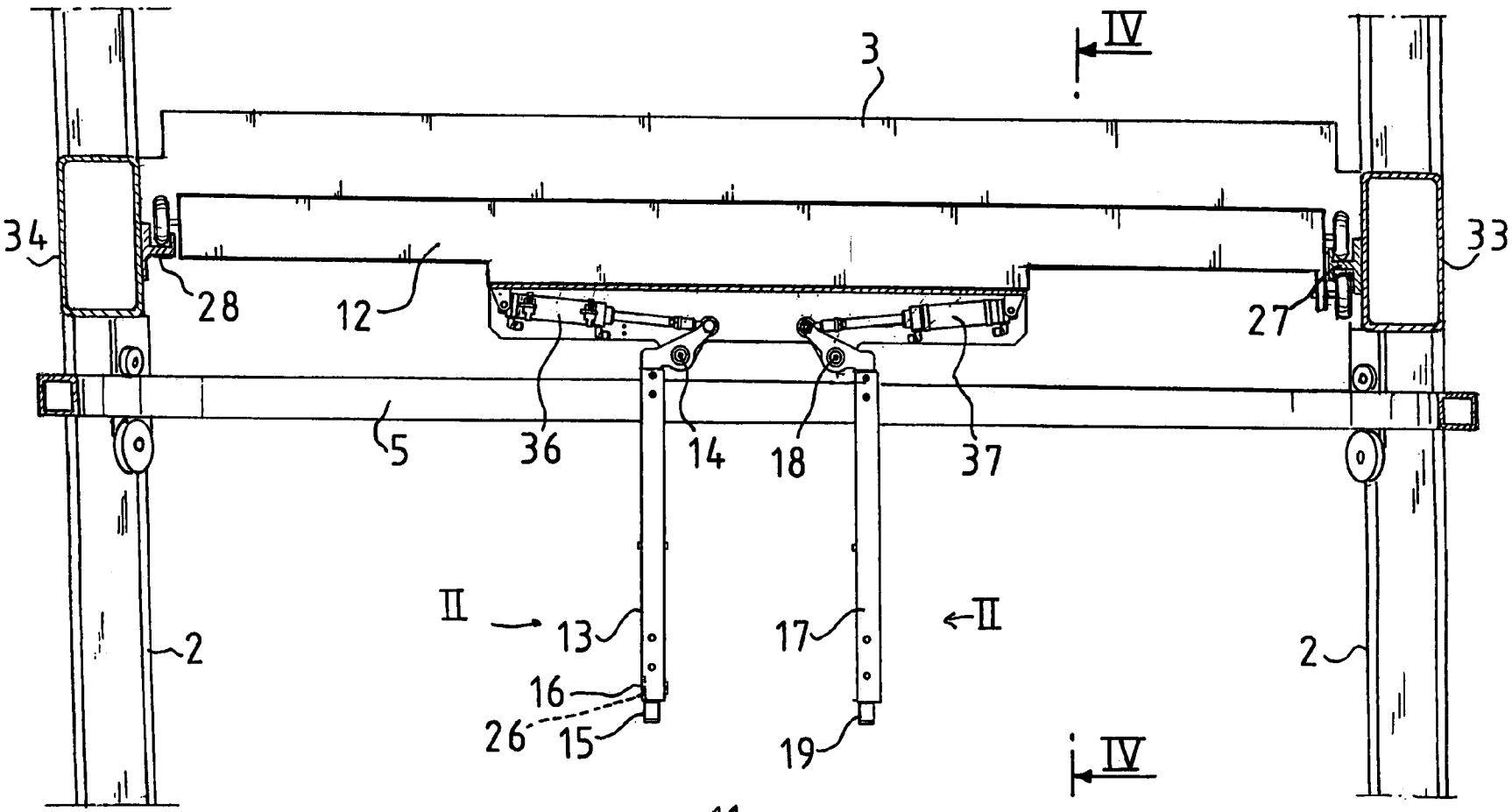
Figure 4:
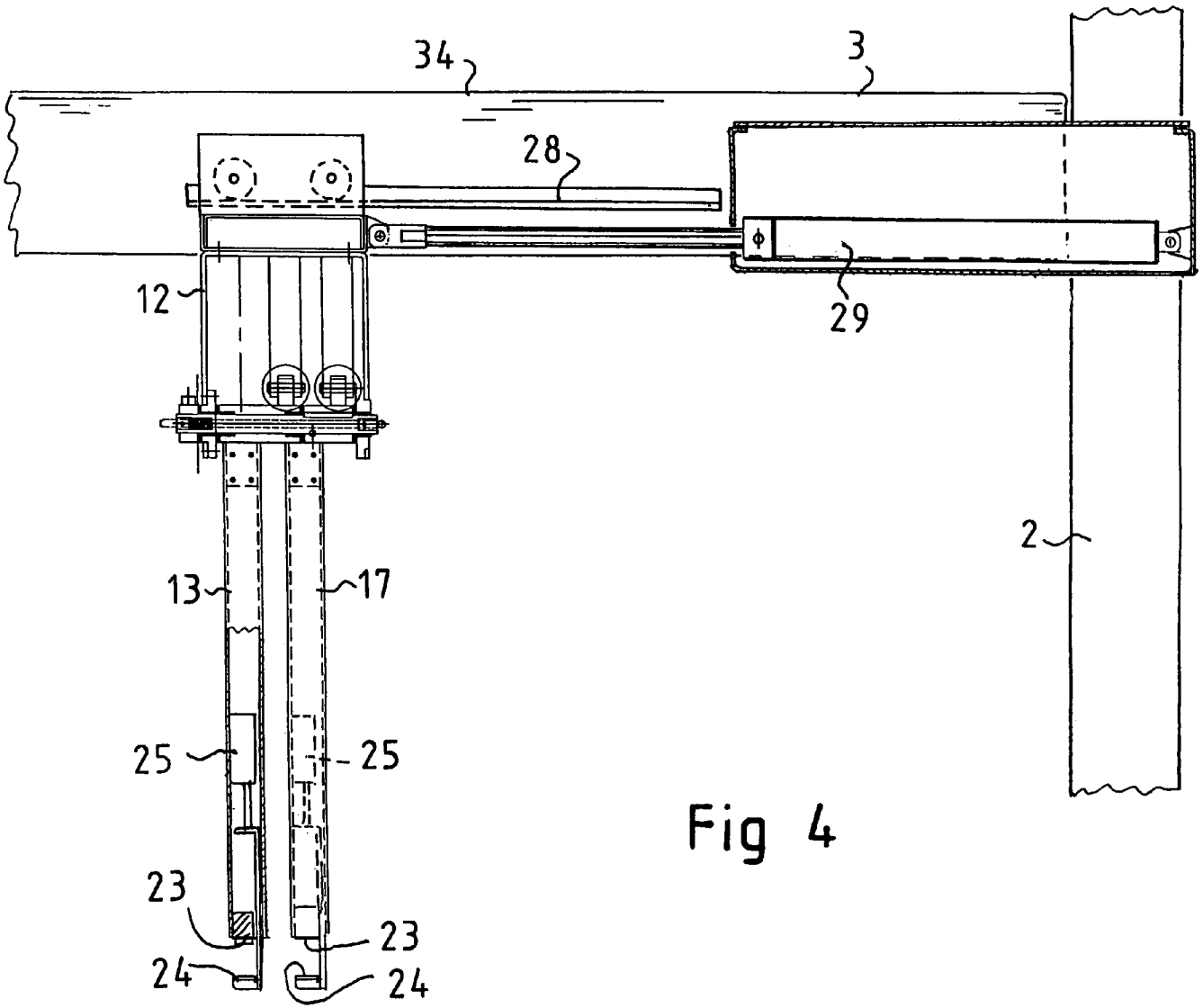
Figure 5:
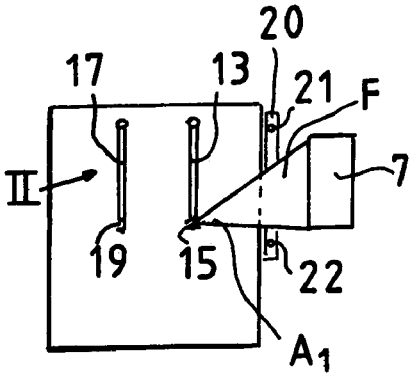
Figure 6:
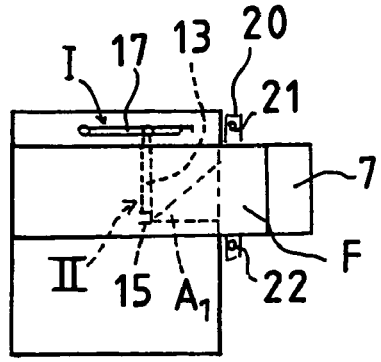
Figure 7:
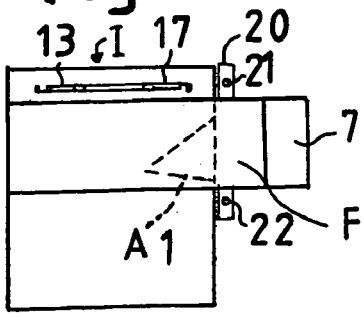
FIG. 7 illustrates a situation where the first swing arm 13 has next been turned to the horizontal position I from between the object and the foil web layer around the object.
Figure 8:
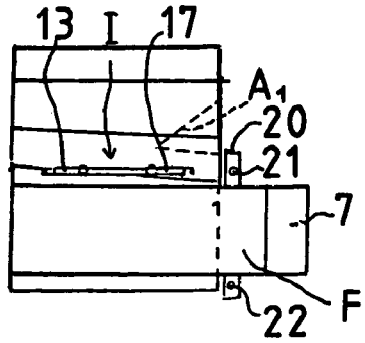
FIG. 8 illustrates a situation where a desired amount of foil web has been wrapped in a spiral fashion around the object while the first swing arm 13 and the second swing arm 17 are in the horizontal position I until a point near the lower part of the object is reached, where the foil web is to be terminated.
Figure 9:
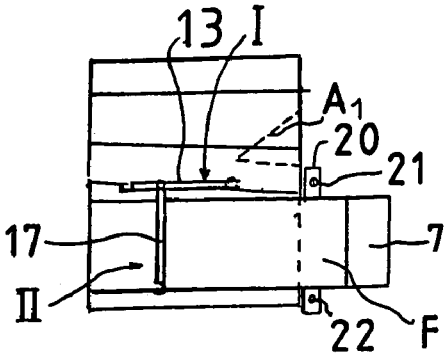
FIG. 9 illustrates a situation where the termination of the foil web is started by turning the second swing arm 17 from the horizontal position shown in FIG. 8 to the upright position II and set to a position near the object.
Figure 10:
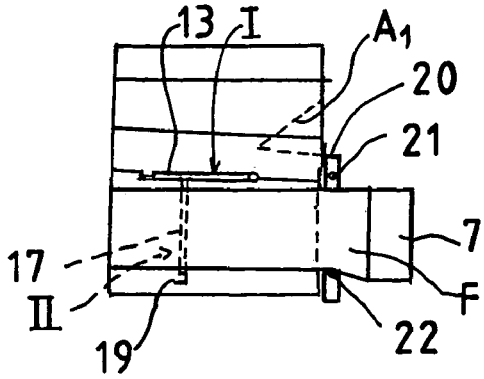

FIG. 10 illustrates a situation where at least one foil web layer has been wrapped around the second swing arm 17 and the object so that at least part of the second swing arm remains between the object and the wrapped foil web layer. The foil web has been constricted somewhat from the lower edge by raising the crinkling device 22 upwards so that the foil web layer wrapped upon the second swing arm 17 does not cover the second holding device 19.

Figure 11:
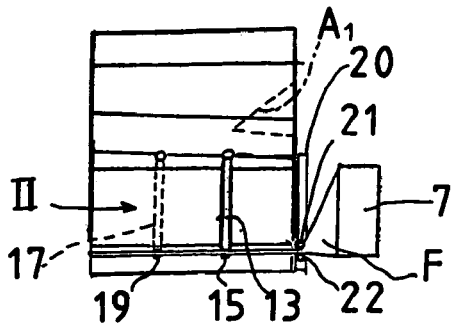

FIG. 11 illustrates a situation where the first swing arm 13 has also been turned from the horizontal position I to the upright position II, and the foil web has been constricted from the upper edge as well by lowering the crinkling device 21 downwards so that the foil web is now in a string-like form. The foil web has been brought to the second holding device 19 of the second swing arm 17 and to the first holding device 15 of the first swing arm 13, so that the holding devices 19 and 15 can form a secure hold on the string-like foil web.

Figure 12:
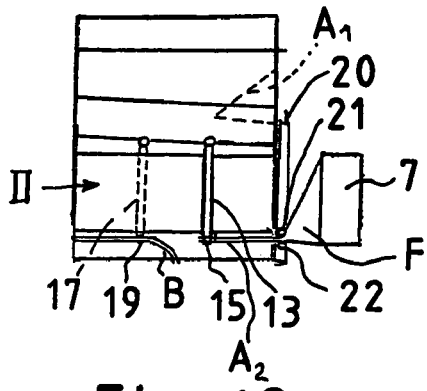

FIG. 12 illustrates a situation where the foil web has been cut by means of the cutting device 16 of the first swing arm 13. The grip of the first and second holding devices on the string-like foil web is still maintained so that the trailing end B of the foil web wrapped around the object is held by the second holding device 19 and the foil web end drawn from the foil dispenser is held by the first holding device 15, thus forming a leading end $A_2$ for a later possible wrapping operation.

Figure 13:
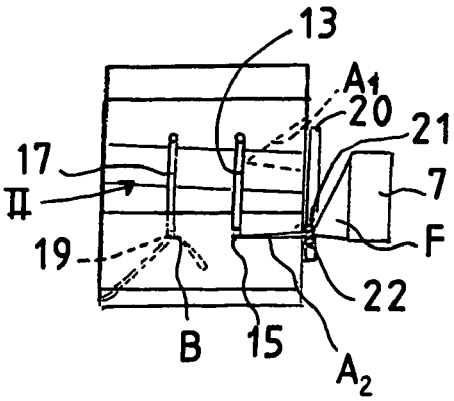

FIG. 13 illustrates a situation where the second swing arm 17 is pulled out from between the object and the foil web layer by moving the lifting frame upwards so that the trailing end B of the foil web remains under the foil web layer. Naturally, the grip of the second holding device 19 on the trailing end B of the foil web wrapped around the object is released at this stage. However, the grip of the first holding device 15 on the leading end $A_2$ of the foil web to be delivered from the foil dispenser is maintained.

Figure 14:
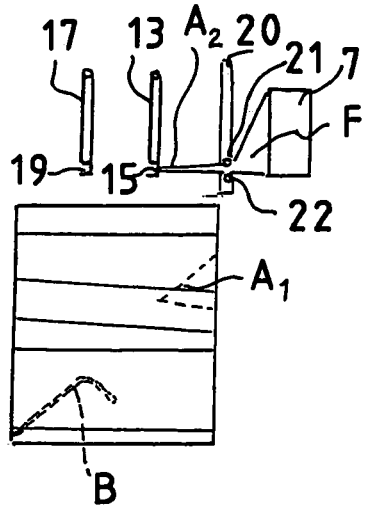
Figure 15:
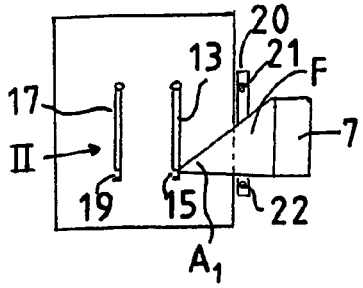
Figure 16:
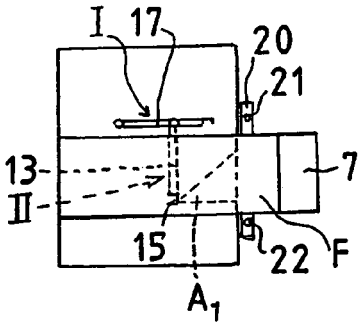
Figure 17:
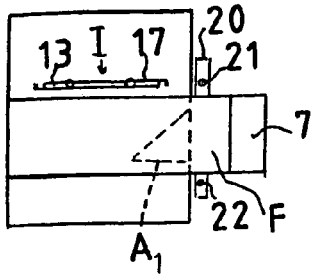
Figure 18:
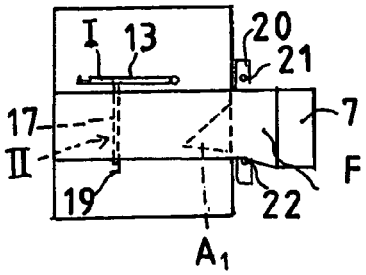
Figure 19:
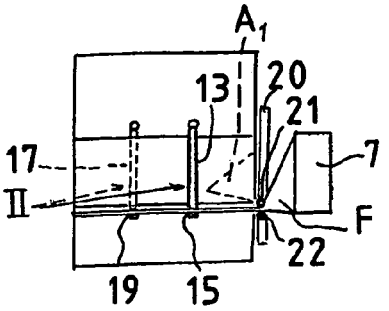
Figure 20:
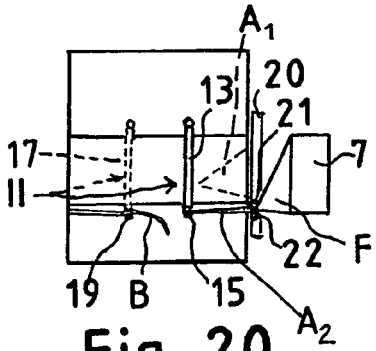
Figure 21:
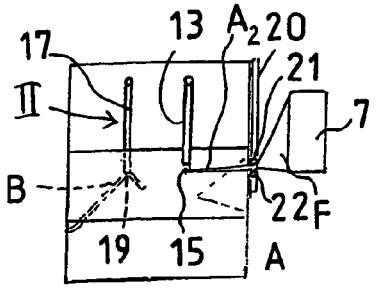
Figure 22:
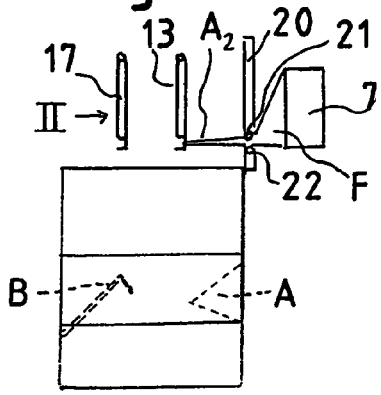

FIG. 14 illustrates a situation where the wrapping of the object has been completed and the lifting frame with all the devices connected to it, such as the gripping and cutting device 11, has been raised to an upper position, allowing the object to be removed from the wrapping station of the wrapping machine.

FIGS. 15–22, corresponding to FIGS. 5–14, illustrate different stages of a collar wrapping operation. As can be seen from the figures, the operational stages are mainly the same as in FIGS. 5–14, with the difference that the lifting frame 3 is held stationary, in other words, no spiral wrapping is performed but the wrapping action is started and ended at the same point relative to the vertical direction of the object.

The invention is not limited to the embodiment examples described above; instead, many variations are possible within the scope of the inventive concept defined in the claims.

The invention claimed is:

1. A wrapping machine for wrapping a plastic foil web around an object, said wrapping machine comprising:

a machine frame supported on a fixed base and comprising vertical upright columns;

a lifting frame moveable upwards and downwards in a vertical direction while guided by the upright columns;

power means for moving the lifting frame;

a circular guide track supported on the lifting frame so as to be movable therewith;

a foil dispenser on which a foil web roll is rotatably mountable, said foil dispenser being moveable along and guided by the circular guide track to circulate about the object to be packaged for delivering the plastic foil web from the foil web roll to form a wrapping around the object to be packaged; and a gripping and cutting device which is coupled to the lifting frame so as to be vertically movable together with said lifting frame and comprises:

a device frame;

a first swing arm connected to the device frame by a first joint so as to be pivotable between a first horizontal position and a first vertical position, said first swing arm comprising a first holding device for griping and holding the foil web, and a cutting device for cutting the foil web; and a second swing arm connected to the device frame by a second joint disposed at a distance from the first joint so as to be pivotable between a second horizontal position and a second vertical position, said second swing arm comprising a second holding device for gripping and holding the foil web;

wherein the wrapping machine further comprises a crinkling device connected to the foil dispenser and having crinkling means for reducing a width of the foil web delivered from the foil dispenser so that the foil web is constricted to have a form of a string; and the holding devices are configured to grip the constricted foil web.

2. The wrapping machine according to claim 1, wherein each of the holding devices comprises:

a dog placed at an end of the respective swing arm;

a clutch guided by the swing arm and movable towards and away from the dog for pressing the constricted foil web between the dog and the clutch; and further power means for actuating the clutch.

3. The wrapping machine according to claim 2, wherein the cutting device comprises a cutting blade for cutting the constricted foil web.

4. The wrapping machine according to claim 1, wherein the lifting frame comprises substantially horizontal guide rails along which the device frame is horizontally moveable to move the gripping and cutting device towards and away from the object to be wrapped; and further power means for moving the device frame.

5. The wrapping machine according to claim 1, wherein each of the holding devices comprises:

a dog placed at an end of the respective swing arm;

a clutch guided by the swing arm and movable towards and away from the dog for pressing the constricted foil web between the dog and the clutch; and first power means for actuating the clutch; and the lifting frame comprises substantially horizontal guide rails along which the device frame is horizontally moveable to move the gripping and cutting device towards and away from the object to be wrapped; and second power means for moving the device frame.

6. The wrapping machine according to claim 5, wherein the cutting device comprises a cutting blade for cutting the constricted foil web.

7. The wrapping machine according to claim 5, wherein the first and second power means are pneumatic cylinders.

8. The wrapping machine according to claim 1, wherein the cutting device comprises a cutting blade for cutting the constricted foil web at a position between said holding devices.

9. A wrapping machine for wrapping a web around an object, said wrapping machine comprising:

a machine frame supported on a fixed base and comprising upright columns;

a lifting frame moveable upwards and downwards along the upright columns;

a driving mechanism for moving the lifting frame;

a closed track supported on the lifting frame so as to be movable therewith;

a web dispenser for rotatably supporting thereon a roll of said web, said web dispenser being moveable along and guided by the track to travel around the object to be packaged for delivering the web from the roll to form a wrapping around the object to be packaged; and a gripping and cutting device which is coupled to the lifting frame so as to be vertically movable together with said lifting frame and comprises:

a device frame;

a first swing arm pivotably connected to the device frame by a first joint, said first swing arm comprising a first holding device for gripping and holding the web, and a cutting device for cutting the web; and a second swing arm pivotably connected to the device frame by a second joint disposed at a distance from the first joint, said second swing arm comprising a second holding device for gripping and holding the web;

wherein the wrapping machine further comprises crinkling elements moveable relative to each other for narrowing a width of said web delivered from the web dispenser so that the web is gathered between said crinkling elements; and the holding devices are configured to grip the gathered web.

10. The wrapping machine according to claim 9, wherein each of the holding devices comprises:

a dog at an end of the respective swing arm;

a clutch guided by the swing arm and movable towards and away from the dog for pressing and holding the gathered web between the dog and the clutch.

11. The wrapping machine according to claim 10, wherein the cutting device comprises a blade for cutting the gathered web.

12. The wrapping machine according to claim 9, wherein the lifting frame comprises transverse guide rails along which the device frame is moveable to move the gripping and cutting device towards and away from the object to be wrapped.

13. The wrapping machine according to claim 9, wherein each of the holding devices comprises:

a dog at an end of the respective swing arm;

a clutch guided by the swing arm and movable towards and away from the dog for pressing and holding the gathered web between the dog and the clutch; and a first driving element for moving the clutch; and the lifting frame comprises transverse guide rails along which the device frame is moveable to move the gripping and cutting device towards and away from the object to be wrapped; and a second driving clement for moving the device frame.

14. The wrapping machine according to claim 13, wherein the cutting device comprises a blade for cutting the gathered web.

15. The wrapping machine according to claim 13, wherein the first and second driving elements are pneumatic cylinders.

16. The wrapping machine according to claim 9, wherein the cutting device comprises a blade for cutting the gathered web at a position between said holding devices.

* * * * *